United States Patent [19]

Polk

[11] 4,416,372

[45] Nov. 22, 1983

[54] DRYWALLER'S TOOL BOX

[76] Inventor: Gary L. Polk, 10369 Gold Coast Pl., San Diego, Calif. 92126

[21] Appl. No.: 427,390

[22] Filed: Sep. 29, 1982

[51] Int. Cl.[3] ..... B65D 85/28

[52] U.S. Cl. ..... 206/372; 206/362; 206/15.3; 312/DIG. 33

[58] Field of Search ..... 206/15.2, 15.3, 348, 206/349, 361, 362, 372, 373, 374, 375, 376, 377, 378, 379, 380, 382, 391; 312/207, DIG. 33

[56] References Cited

U.S. PATENT DOCUMENTS

| | | | |
|---|---|---|---|
| 1,202,355 | 10/1916 | Bernhardt | 206/361 |
| 1,657,854 | 1/1928 | Clemensen | 206/372 |
| 2,020,394 | 11/1935 | Bates | 206/362 |
| 2,533,355 | 12/1950 | Comfort | 206/15.3 |
| 2,667,394 | 1/1954 | Goetz et al. | 206/382 |
| 2,788,827 | 4/1957 | Banner | 206/373 |
| 2,954,251 | 7/1960 | Eichner | 206/362 |
| 3,004,660 | 10/1961 | Hofmann | 206/382 |
| 3,090,271 | 5/1963 | Castelli | 206/394 |
| 3,227,265 | 1/1966 | Schneider | 206/382 |
| 3,291,295 | 12/1966 | Caligiuri | 206/15.3 |
| 3,870,148 | 3/1975 | Hite | 206/372 |
| 3,917,106 | 11/1975 | Bargetzi | 206/349 |
| 4,303,188 | 12/1981 | Calabrese | 206/372 |

*Primary Examiner*—Joseph Man-Fu Moy
*Assistant Examiner*—David Fidei
*Attorney, Agent, or Firm*—Ralph S. Branscomb

[57] ABSTRACT

The invention is a carrying case for drywaller's tools, which constitute primarily a series of paste applicator blades of varying widths, the case comprising a case body itself, and a rack contained within the case which defines a series of parallel slots into which the blades are inserted. The rack is of narrowing width from one end to the other to accommodate neatly the graduated blade size of a standard set of drywaller hanger's blades, and the lid for the case has an aperture through which protrude the handles of the blades. A specialized carrying strap, and mounting loops on the side of the case, hold tape and other tools.

9 Claims, 5 Drawing Figures

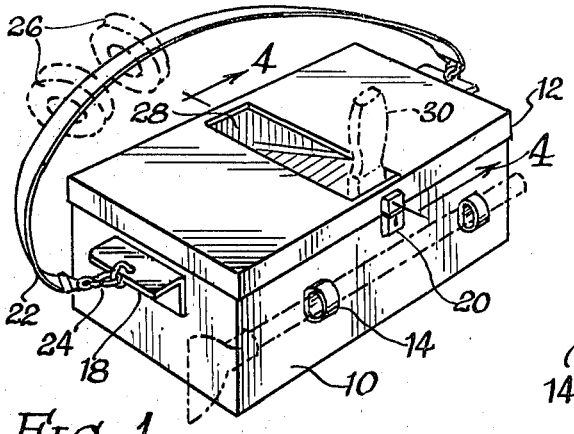
FIG. 1
FIG. 2
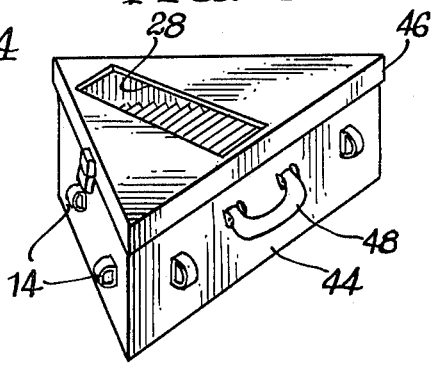
FIG. 3
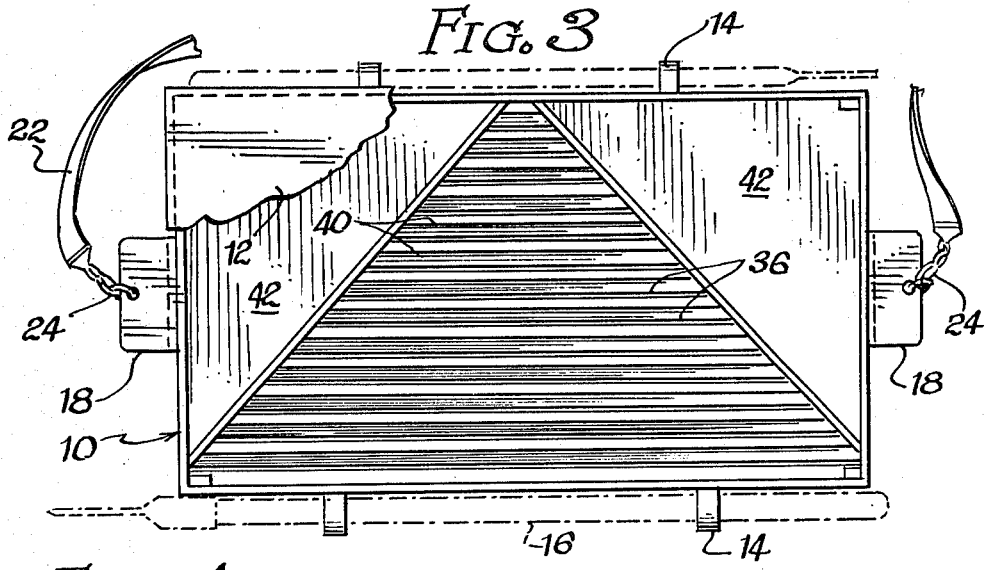
FIG. 4
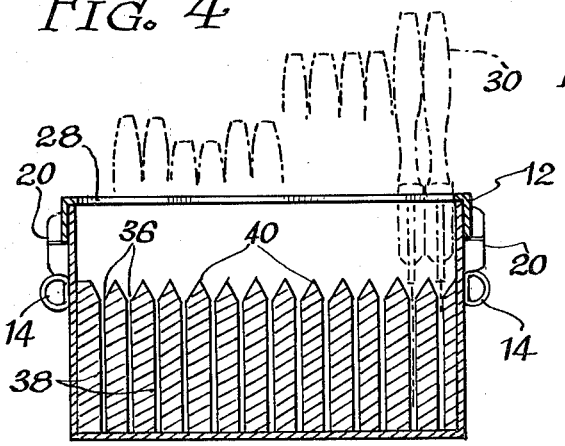
FIG. 5
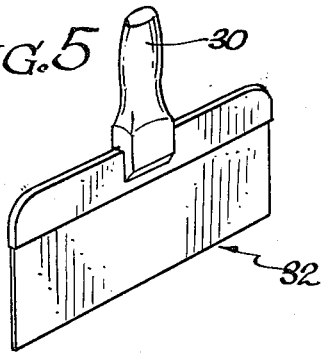

DRYWALLER'S TOOL BOX

BACKGROUND OF THE INVENTION

The invention is in the field of construction tools, and particularly pertains to a case for holding the tools used by a drywall hanger. More specifically, as drywall work actually encompasses two skills, often done by two separate people, the drywall hanger and the drywall taper, this tool box is actually more useful to a taper, although the hanger can keep tools in the box too, and the taper and hanger in practice are often the same person. For simplicity, in their application, the tool box user will be referred to as the "drywaller" or "drywall hanger." A drywall hanger principally uses blades to screed off and smooth the drywall paste of joints. These blades come in a variety of widths, so that on the job a well equipped drywaller might have a dozen or more blades varying in size.

Currently, these blades are disorganized and are likely to be thrown loosely in a box or an open tool box, and they then may be laid around the job site, costing the drywaller valuable time when looking for a different sized blade. There is a need for an organizer case which will keep the blades in order, and easily accessible to the drywaller irrespective of the particular blade size he needs.

SUMMARY OF THE INVENTION

The instant invention fulfills the above-stated need by providing a case the interior of which is sub-divided into a plurality of graduated parallel slots. In the primary embodiment, two triangular compartments are defined alongside the main blade-holding rack, for use in holding other tools, or for carrying beer or other beverages to the job site, as the drywaller can even put ice in these compartments.

Other advantageous features include a carrying strap which is releasible at least at one end, and which can hold rolls of drywall tape. Also, because the lid of the blade rack is open and the blade handles protrude through it, the drywaller can tell at a glance if he has his full array of tools without opening the case. Because the tape and other tools are connected to the exterior of the case, everything that the drywaller needs to clearly visible so that he does not risk arriving at the job site without a complete tool set.

BRIEF DESCRIPTION OF THE DRAWINGS

FIG. 1 is a perspective view of the preferred embodiment of the invention;

FIG. 2 is a perspective view of a modification of the invention wherein the rectangular outer case is omitted and the case is triangular and doubles as the blade rack;

FIG. 3 is a top elevation view of the preferred embodiment with the lid off;

FIG. 4 is a section taken along line 4—4 of FIG. 3 and showing the blade handles in phantom; and FIG. 5 is a perspective view of a typical drywaller's paste-applying blade.

DETAILED DESCRIPTION OF THE PREFERRED EMBODIMENT

The tool box is comprised of a case 10 which is a rectangular box-like member, and a lid 12. The case and lid may be made of metal, hard fiberboard, plastic, or any other suitable material. On the exterior of the case are mounting loops 14 to mount the long-handled blades

16, and on the ends of the preferred embodiment are carrying handles 18. In addition, because in the preferred embodiment the lid completely removes from the case for more convenient access to the blades, there are two locks 20, although one lock, with an inner-engaging means on the other edge, would also work well.

In the preferred embodiment, to the handles 18 is attached a carrying strap 22, having a releasible clip 24 at each end so that the user may avail himself of the rolls 26 of drywall tape. It should be noted that by this arrangement, the drywaller has an instant idea of just how much tape he has, and thus he can avoid the present situation in which he may have to stop work at the job site because the rolls of tape he thought he had down in the bottom of his tool box were not there.

The lid 12 has a central, laterally extended cutout 28 through which extend the blade handles 30 of the drywaller's blades 32.

Inside the case 10 is a rack which is divided into a series of parallel slots 36, such as by the dividers 38 with tapered top edges 40 shown in the preferred embodiments. Although utilization of these dividers would make the box more expensive than a system wherein the sidewalls of the rack were grooved to seat the side edges of the blades, the dividers at the tapered tops make it extremely easy to insert the blades without danger of misalignment, and thus valuable time is saved.

In the embodiment shown in FIGS. 1 and 3, two side compartments 42 are provided for miscellaneous tools, and as mentioned above can also hold cold beer or soda, and even the drywaller's lunch. Unassigned space of this nature is valuable inasmush as no matter how carefully planned the rest of the case is, the individual needs of particular drywallers can only be satisfied by providing some extra space in the case.

However, this space could be omitted, as shown in the modification in FIG. 2 wherein the outer case 44 merges with the rack itself, and is covered by triangular lid 46. The other features are basically the same, although handle 48 is somewhat different. FIG. 2 also illustrates a slight modification of the divider structure wherein the divider decreases in height toward the apex of the box.

Thus in a simple, inexpensive and practical case, the drywaller now has an organized and convenient means of keeping his tools in order, and will save valuable time on the job site by having the tools presented to him in an organized fashion as he changes from one blade to the next, and by being apprised visually at all times of just what he has in the way of tools and drywall tape in his case.

While the preferred embodiment of the invention has been described, other modifications may be made thereto and other embodiments may be devised within the spirit of the invention and scope of the appended claims.

What is claimed is:

1. A drywaller hanger's tool kit comprising:

(a) a case;

(b) a blade-holding rack defining a plurality of parallel vertical slots;

(c) said rack having converging sidewalls such that the width of said slots progressively decrease from a widest slot to a narrowest slot; and (d) a lid for said case having a blade handle clearance cutout spanning said slots centrally and perpendicular thereto, such that a plurality of drywall paste applicator blades of decreasing blade width can be stored in the respective decreasing-width slots of said rack with the handles of said blades extending through said cutout when said lid is on said case.

2. Structure according to claim 1 wherein said case is rectangular and said rack is substantially triangular and symmetrically disposed in said case about a central transverse plan to define two triangular compartments therein alongside said rack.

3. Structure according to claim 1 wherein said slots are defined by a series of partitions, and the height of said partitions decreases with the width of said slots.

4. Structure according to claim 1 and including a plurality of fasteners mounted to the exterior of said case for fastening drywall tools.

5. Structure according to claim 4 wherein said fasteners include a pair of aligned, horizontal loops for engaging the handle of a long-handled drywall paste blade.

6. Structure according to claim 1 wherein said case includes oppositely extended handgrips on the opposite sides thereof.

7. Structure according to claim 6 and including a carrying strap connected to said case, said strap being releasible at at least one end dimensioned to pass through the center of a roll of drywall tape, whereby a series of rolls of drywall tape can be stowed on said strap.

8. Structure according to claim 7 wherein said case has a pair of oppositely directed handgrips on the opposite sides thereof and said strap connects to said handgrips.

9. Structure according to claim 1 wherein said slots are defined by a plurality of partitions having tapered top edges to act as blade guides.

* * * * *